US010286537B2

(12) United States Patent
Koch et al.

(10) Patent No.: US 10,286,537 B2
(45) Date of Patent: May 14, 2019

(54) PORTABLE POWER TOOL

(71) Applicant: Hilti Aktiengesellschaft, Schaan (LI)

(72) Inventors: Olaf Koch, Kaufering (DE); Theo Kiesel, Pullach (DE); Helene Kaps, Munich (DE); Matthias Keith, Kaufbeuren (DE)

(73) Assignee: Hilti Aktiengesellschaft, Schaan (LI)

( * ) Notice: Subject to any disclaimer, the term of this patent is extended or adjusted under 35 U.S.C. 154(b) by 405 days.

(21) Appl. No.: 15/034,723

(22) PCT Filed: Oct. 30, 2014

(86) PCT No.: PCT/EP2014/073304

§ 371 (c)(1),
(2) Date: May 5, 2016

(87) PCT Pub. No.: WO2015/067517

PCT Pub. Date: May 14, 2015

(65) Prior Publication Data

US 2016/0279778 A1 Sep. 29, 2016

(30) Foreign Application Priority Data

Nov. 6, 2013 (EP) ..... 13191708

(51) Int. Cl.
*B25D 17/11* (2006.01)
*B25D 17/06* (2006.01)

(52) U.S. Cl.
CPC ..... *B25D 17/11* (2013.01); *B25D 17/06* (2013.01); *B25D 2250/191* (2013.01);
(Continued)

(58) Field of Classification Search
CPC ..... B25D 17/11; B25D 17/06
See application file for complete search history.

(56) References Cited

U.S. PATENT DOCUMENTS 4,310,055 A 1/1982 Wanner et al.
2007/0261871 A1 11/2007 Ohlendorf
(Continued)

FOREIGN PATENT DOCUMENTS

CN 1853865 A 11/2006
CN 101066588 A 11/2007
(Continued)

OTHER PUBLICATIONS

PCT/EP2014/073304, International Search Report dated Jan. 29, 2015, with partial English translation (Five (5) pages).
(Continued)

*Primary Examiner* — Andrew M Tecco
*Assistant Examiner* — Praachi M Pathak
(74) *Attorney, Agent, or Firm* — Crowell & Moring LLP

(57) ABSTRACT

A portable power tool is disclosed. The tool has a tool holder in which a tool can be moveably inserted on a working axis in a striking direction. A percussion mechanism has a striker coupled via a pneumatic chamber to an exciter moved periodically along the working axis and an intermediate striker arranged in the striking direction downstream from striker. The intermediate striker is guided in a slide bearing with a tolerance coaxially to the working axis. The intermediate striker has a ring-shaped bead. A hollow-cylindrical backstop is arranged in the striking direction upstream from the bead. The backstop is moveably guided on a sliding surface with radial play along working axis. The radial play is at least three times as large as a tolerance of the guide of the intermediate striker in the slide bearing.

6 Claims, 2 Drawing Sheets

(52) U.S. Cl.
CPC .. *B25D 2250/245* (2013.01); *B25D 2250/371* (2013.01); *B25D 2250/391* (2013.01)

(56) References Cited

U.S. PATENT DOCUMENTS

| | | | | |
|---|---|---|---|---|
| 2008/0164042 | A1 | 7/2008 | Mascall | |
| 2011/0073338 | A1* | 3/2011 | Ikuta ..... | B25D 17/24<br>173/162.2 |

FOREIGN PATENT DOCUMENTS

| | | | |
|---|---|---|---|
| EP | 1 238 759 | A1 | 9/2002 |
| EP | 2 266 761 | A1 | 12/2010 |

OTHER PUBLICATIONS

European Search Report issued in European counterpart application No. 13191708.0-1709 dated Feb. 26, 2014, with Statement of Relevancy (Seven (7) pages).
Chinese Office Action issued in Chinese counterpart application No. 201480061011.9 dated Nov. 17, 2016, with English translation (Fourteen (14) pages).

* cited by examiner

PORTABLE POWER TOOL

This application claims the priority of International Application No. PCT/EP2014/073304, filed Oct. 30, 2014, and European Patent Document No. 13191708.0, filed Nov. 6, 2013, the disclosures of which are expressly incorporated by reference herein.

BACKGROUND AND SUMMARY OF THE INVENTION

The present invention relates to a portable power tool with a percussion mechanism, particularly for use with chiseling tools.

A percussion mechanism has multiple moved components that move repeatedly along a working axis and strike each other. This results in considerable noise generation. Precise guiding of the striking components parallel to the working axis prevents diagonal skewing of the striking components and rattling due to a partially radial movement.

The portable power tool according to the invention has a tool holder, in which a tool can be movably inserted on a working axis in a striking direction. A percussion mechanism has a striker coupled via a pneumatic chamber to an exciter moved periodically along the working axis and an intermediate striker arranged in the striking direction downstream from the striker. The intermediate striker is guided in a slide bearing with a tolerance coaxially to the working axis. The intermediate striker has a ring-shaped bead. A hollow cylindrical backstop is arranged in the striking direction upstream from the bead. The backstop is moveably guided on a sliding surface with radial play along the working axis. The radial play is at least three times as large as a tolerance of the guide of the intermediate striker in the slide bearing. The striking components are rigidly guided as is normal. In contrast to this, it may prove to be advantageous to not rigidly guide a backstop for the intermediate striker. Even though it can now move radially and thereby rattle, the entire noise generation is less. The impact of the intermediate striker induces a radial vibration in the backstop, which also depends on the guide. The rigid guide hereby proves to be more unfavorable since the resulting higher frequencies stimulate the housing in a resonant manner.

A design provides that the mass of the backstop amounts to between 20% and 40% of the mass of the intermediate striker. The backstop may be supported on a damping element opposite the striking direction. In particular, the backstop may be inserted in a pre-tensioned manner between the damping element and an additional damping element arranged in the striking direction.

A design provides that a spring element encompasses a radial external surface of the backstop. The spring element centers the backstop to the working axis after an impact of the intermediate striker has occurred.

DETAILED DESCRIPTION OF THE DRAWINGS

Figure 1:
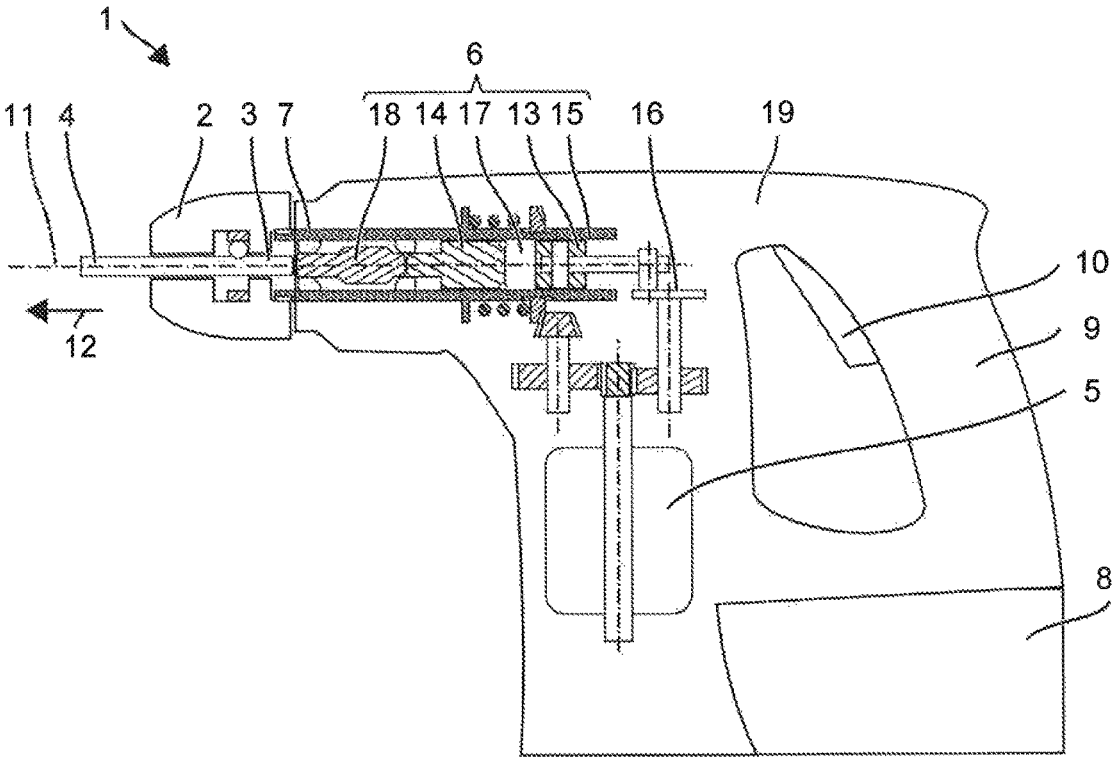
FIG. 1 illustrates a drill hammer.

The same or function-identical elements are indicated using the same reference signs in the drawings, unless displayed otherwise.

As an example of a chiseling portable power tool, FIG. 1 schematically depicts a drill hammer 1. Drill hammer 1 has a tool holder 2, in which a shaft end 3 of a tool, e.g., a chisel 4, can be inserted. A primary drive of drill hammer 1 is formed by a motor 5, which drives a percussion mechanism 6 and a driven shaft 7. A battery pack 8 or a power cable supply motor 5 with electricity. A user can guide drill hammer 1 by means of a hand grip 9 and start drill hammer 1 by means of system switch 10. In the operating mode, drill hammer 1 continually turns drill 4 about a working axis 11 and can thereby strike drill 4 in a striking direction 12 along working axis 11 into a substrate.

Percussion mechanism 6 is a pneumatic percussion mechanism 6. An exciter piston 13 and a striker 14 are moveably guided in a guide tube 15 in percussion mechanism 6 along working axis 11. Exciter piston 13 is coupled via a cam 16 to motor 5 and constrained to a periodic, linear movement. A connecting rod connects cam 16 to exciter piston 13. A pneumatic spring formed by a pneumatic chamber 17 between exciter piston 13 and striker 14 couples a movement of striker 14 to the movement of exciter piston 13. Striker 14 indirectly transmits part of its momentum to the chisel 4 via an essentially resting intermediate striker 18. Percussion mechanism 6 and preferably the other drive components are arranged inside a machine housing 19.

Intermediate striker 18 has an essentially cylindrical main body 20. Intermediate striker 18 is guided in a slide bearing 21, 22 coaxially to working axis 11. The sample two-part slide bearing 21, 22 encompasses with a front sleeve 21 a machine-side end of main body 20 and with a rear sleeve 22 the tool-side end of main body 20. The diameter of main body 20 deviates by a distance 23 of less than 50 μm from the interior diameter of sleeves 21, 22. This corresponds to tolerance H7 typical for slide bearings 21, 22 and for sleeves 21, 22 and g7 for intermediate striker 18, respectively according to the ISO standard. The narrow tolerance ensures coaxial guiding, even for forces in the range of 10 kN that occur during the strike.

Figure 2:
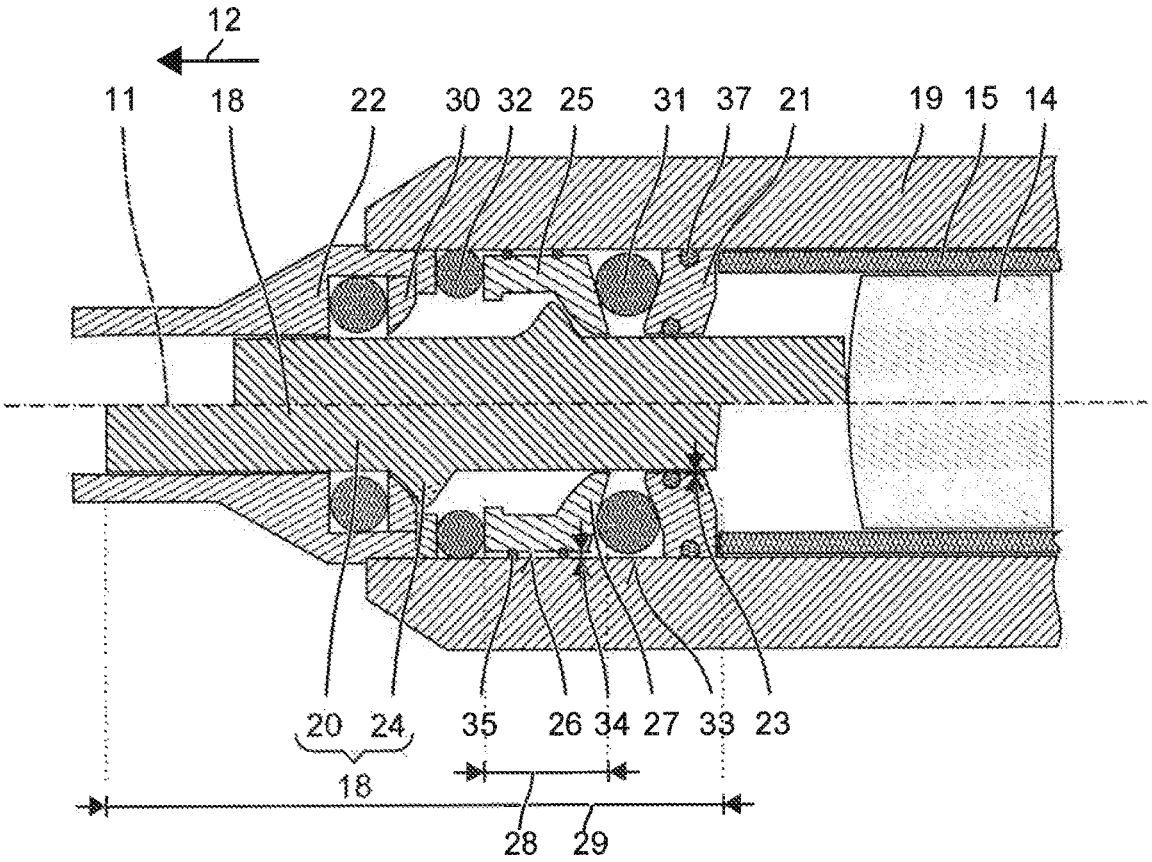
FIG. 2 is a partial section of the drill hammer.

Intermediate striker 18 is moveable between a work position (upper half of image, FIG. 2) and a position advanced in striking direction 12 (lower half of image, FIG. 2). Intermediate striker 18 has a bead 24 protruding radially relative to main body 20, the bead being provided preferably in a middle section of intermediate striker 18. Bead 24 lies against a backstop 25 opposite the striking direction 12, when intermediate striker 18 is in the work position.

Backstop 25 has a hollow-cylindrical shape with a radial exterior surface 26. Sample backstop 25 has a collar 27 protruding radially inward, against which bead 24 lies opposite the striking direction 12. A length 28 of backstop 25, particularly of the radial exterior surface 26, lies in a range of 10% and 25% of length 29 of intermediate striker 18. The motion of intermediate striker 18 in the striking direction 12 is stopped by a damped end stop 30 when bead 24 comes into contact with it in striking direction 12. The free path of intermediate striker 18 from the work position to end stop 30 lies in a range from 1 cm to 3 cm for small drill hammers and in a range from 3 cm to 5 cm for large chisel hammers.

Backstop 25 is supported opposite striking direction 12 by a damping element 31 on machine housing 19. Backstop 25 shifts slightly relative to the housing, when intermediate striker 18 impacts backstop 25. Backstop 25 also has a not negligible mass relative to intermediate striker 18 to reduce the rebound impact. The mass of backstop 25 preferably lies in a range of 20% to 40% of the mass of intermediate striker 18. The large mass of backstop 25 stems from its axial dimension 28. Backstop 25 is preferably clamped between damping element 31 and another damping element 32 arranged in striking direction 12. The two damping elements 31, 32 are pre-tensioned along working axis 11. Backstop 25 is maintained in a rest position along working axis 11 by means of the two damping or spring elements 31, 32.

Backstop 25 is guided coaxially to working axis 11, i.e., coaxially to intermediate striker 18. The axial guiding of backstop 25 occurs through its cylindrical exterior surface 26. The axial dimension of exterior surface 26 is approximately equal to the length of backstop 25. The counterpart of the guide may be for example a cylindrical radial interior surface 33 of machine housing 19. This guide is equipped with obvious radial play 34. Play 34 should be at least 0.15 mm, in other words more than triple the guide tolerance 23 of slide bearing 21, 22 for intermediate striker 18. Play 34 is to be determined in a radial direction between the metal exterior surface 26 of backstop 25 and the guiding metal interior surface 33, in this case of machine housing 19. The high tolerance proves to be beneficial to decrease noise generation of the impact of the intermediate striker 18 on backstop 25.

Backstop 25 may be equipped with radial spring elements 35 made of an elastomer, which encompass its exterior surface 26 and contact interior surface 33.

The front slide bearing 21 may have an inserted sealing ring 37, which is arranged on the interior side of sleeve 21 in a manner that offsets tolerance 23. Sealing ring 37 wipes fine dust from intermediate striker 18, and prevents dust from penetrating into percussion mechanism 6.

In the depicted embodiment, guide tube 15 is a component separate from machine housing 19 and is arranged completely within machine housing 19. Guide tube 15 may also be sectionally exposed, therefore forming a part of the external machine housing 19.

The invention claimed is:

1. A portable power tool, comprising:

a tool holder, wherein a tool is insertable into the tool holder on a working axis;

a striker that is coupled via a pneumatic chamber to an exciter which is periodically moveable along the working axis;

an intermediate striker disposed in a striking direction downstream from the striker, wherein the intermediate striker is guided in a slide bearing with a tolerance between a main body of the intermediate striker and the slide bearing and wherein the intermediate striker has a bead;

a backstop which is disposed in the striking direction upstream from the bead; and a slide surface in which the backstop is moveably guided with a radial play;

wherein the radial play is at least three times as large as the tolerance.

2. The portable power tool according to claim 1, wherein a mass of the backstop is between 20% and 40% of a mass of the intermediate striker.

3. The portable power tool according to claim 1, wherein the backstop is supported in a direction that is opposite from the striking direction on a first damping element.

4. The portable power tool according to claim 3, wherein the backstop is disposed between the first damping element and a second damping element that is disposed in the striking direction from the first damping element.

5. The portable power tool according to claim 1, wherein a spring element encompasses a radial exterior surface of the backstop.

6. The portable power tool according to claim 1, wherein the backstop is steel.

* * * * *